US010381743B2

(12) United States Patent
Bialer et al.

(10) Patent No.: US 10,381,743 B2
(45) Date of Patent: Aug. 13, 2019

(54) CURVED SENSOR ARRAY FOR IMPROVED ANGULAR RESOLUTION

(71) Applicant: GM GLOBAL TECHNOLOGY OPERATIONS LLC, Detroit, MI (US)

(72) Inventors: Oded Bialer, Petah Tivak (IL); Igal Bilik, Rehovot (IL)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 326 days.

(21) Appl. No.: 15/409,865

(22) Filed: Jan. 19, 2017

(65) Prior Publication Data

US 2017/0222332 A1 Aug. 3, 2017

Related U.S. Application Data

(60) Provisional application No. 62/287,995, filed on Jan. 28, 2016.

(51) Int. Cl.
*H01Q 21/20* (2006.01)
*H01Q 1/12* (2006.01)
*H01Q 15/16* (2006.01)

(52) U.S. Cl.
CPC ..... *H01Q 21/20* (2013.01); *H01Q 1/125* (2013.01); *H01Q 15/16* (2013.01)

(58) Field of Classification Search
CPC ..... H01Q 21/20; H01Q 21/0025; H01Q 3/26; H01Q 3/267; H01Q 3/2676; H01Q 1/125; H01Q 15/16; H01Q 25/00
USPC ..... 342/268
See application file for complete search history.

(56) References Cited

U.S. PATENT DOCUMENTS

2002/0071345 A1* 6/2002 Chiang ..... G01S 7/521 367/138
2004/0079870 A1* 4/2004 Salmon ..... G01K 11/006 250/234
2005/0159187 A1* 7/2005 Mendolia ..... G01S 5/04 455/562.1
2008/0221454 A1* 9/2008 Davidsen ..... G01S 7/5208 600/459
2008/0291079 A1* 11/2008 Chang ..... G01S 19/21 342/174
2014/0211298 A1* 7/2014 Sayyah ..... H01Q 15/0086 359/298
2017/0038502 A1* 2/2017 Georgiev ..... G02B 3/0056
2017/0082730 A1* 3/2017 Kishigami ..... G01S 7/28
2018/0045818 A1* 2/2018 Majumdar ..... G01S 7/4817
2018/0168536 A1* 6/2018 Park ..... A61B 8/0825

* cited by examiner

*Primary Examiner* — Harry K Liu
(74) *Attorney, Agent, or Firm* — Reising Ethington, P.C.

(57) ABSTRACT

A method is disclosed for optimizing an angular resolution across a field-of-view for an antenna array having a plurality of antenna elements positioned along a curved surface. The method includes selecting a position along the curved surface for a first antenna element in the plurality of antenna elements and calculating subsequent positions for each of the remaining plurality of antenna elements on the antenna array, wherein the subsequent positions are determined relative to the position of the first antenna element and wherein the subsequent positions represent positions at which a maximum angular resolution is achieved for all angles in the field-of-view.

17 Claims, 3 Drawing Sheets

CURVED SENSOR ARRAY FOR IMPROVED ANGULAR RESOLUTION

This application claims the benefit of U.S. provisional patent application No. 62/287,995, filed on Jan. 28, 2016, the entire contents of which are hereby incorporated by reference.

TECHNICAL FIELD

The present invention relates generally to antenna arrays for radar detection systems, and more particularly, to a curved antenna array with high angular resolution in the entire field-of-view.

BACKGROUND

Radars are object-detection systems that use radio waves transmitted and received by an antenna to determine the range, angle, and/or velocity of objects. Most often, radars employ array antennas consisting of multiple antenna elements or sensors that are arranged and interconnected to form an array. Antenna arrays may be directional in that they are designed to focus the antennas radiation pattern towards a particular direction. The direction of the radiation pattern is given by the main beam lobe, which is pointed in the direction where the bulk of the radiated power travels. The directivity and gain of an antenna array can be expressed in terms of the antenna's normalized field strength and array factor, which are fundamental principles of antenna array theory and well known in the art.

The efficiency of an antenna array in terms of directivity and gain depends on the design and geometry of the antenna array. Antenna arrays are generally designed for optimum directivity with high angular resolution. However, angular resolution is proportional to the size of the antenna aperture and the number of antenna elements in the array. High angular resolution requires a large aperture with a large number of antenna elements, which increases the cost of the antenna. In addition, the size of the aperture and number of elements is limited by the antenna element spacing due to ambiguities that arise in widely-spaced antenna arrays. These ambiguities are generally a consequence of grating lobes, which refer to a spatial aliasing effect that occurs when radiation pattern side lobes become substantially larger in amplitude, and approach the level of the main lobe. Grating lobes radiate in unintended directions and are identical, or nearly identical, to the main beam lobes.

In most modern radar systems, antennas arrays are phased arrays configured to steer the main lobe of the radiation pattern in a particular direction. A phase shifter connected to each antenna element, or group of elements, is configured to shift the phase of the signals emitted from the antenna elements in order to provide constructive and/or destructive interference, thereby steering the beams in a desired direction while suppressing those in undesired directions. Phased array antennas having a narrow beam width advantageously have high spatial resolution. However, the scan range (i.e., field-of-view) of planar phased arrays are generally limited to 120° (60° left and 60° right) due to gain degradation of the main lobe as it is steered beyond 60° from boresight (i.e., end-fire angles). The gain degradation and diminished angular resolution in the end-fire scan angles is in part due to the occurrence of grating lobes.

SUMMARY

According to an embodiment of the invention, there is provided a method for optimizing an angular resolution across a field-of view for an antenna array having a plurality of antenna elements positioned along a curved surface. The method includes selecting a position along the curved surface for a first antenna element in the plurality of antenna elements and calculating subsequent positions for each of the remaining plurality of antenna elements on the antenna array, wherein the subsequent positions are determined relative to the position of the first antenna element and wherein the subsequent positions represent positions at which a maximum angular resolution is achieved for all angles in the field-of-view.

According to another embodiment of the invention, there is provided a method for optimizing an angular resolution across a field-of view for an antenna array having a plurality of antenna elements positioned along a curved surface. The method includes determining a range of angles in the field-of-view and determining a position on the curved surface for each of the plurality of antenna elements based on an argument of the maximum operation of an angular resolution function, wherein the positions for each of the plurality of antenna elements represent positions at which a maximum angular resolution is achieved for the range of angles in the field-of-view.

According to yet another embodiment of the invention, there is provided an antenna array that includes a curved surface having a given curvature and a plurality of antenna elements disposed along the curved surface having non-uniform spacing, wherein the position of each of the plurality of antenna elements is determined by maximizing an angular resolution function for all angles in a given field-of-view.

BRIEF DESCRIPTION OF THE DRAWINGS

One or more embodiments of the invention will hereinafter be described in conjunction with the appended drawings, wherein like designations denote like elements, and wherein.

DETAILED DESCRIPTION OF THE ILLUSTRATED EMBODIMENT(S)

The system and method described below are directed to optimizing the angular resolution of an antenna array across the entire field-of view (FOV). The disclosed method exploits the curvature of concave and convex antenna arrays to achieve maximum angular resolution in the entire FOV while minimizing the number of antenna elements in the array. In one embodiment, the method includes determining an optimal element configuration for a given array based on an angular resolution function, the geometry of the array surface, and the number of elements in the array.

Figure 1:
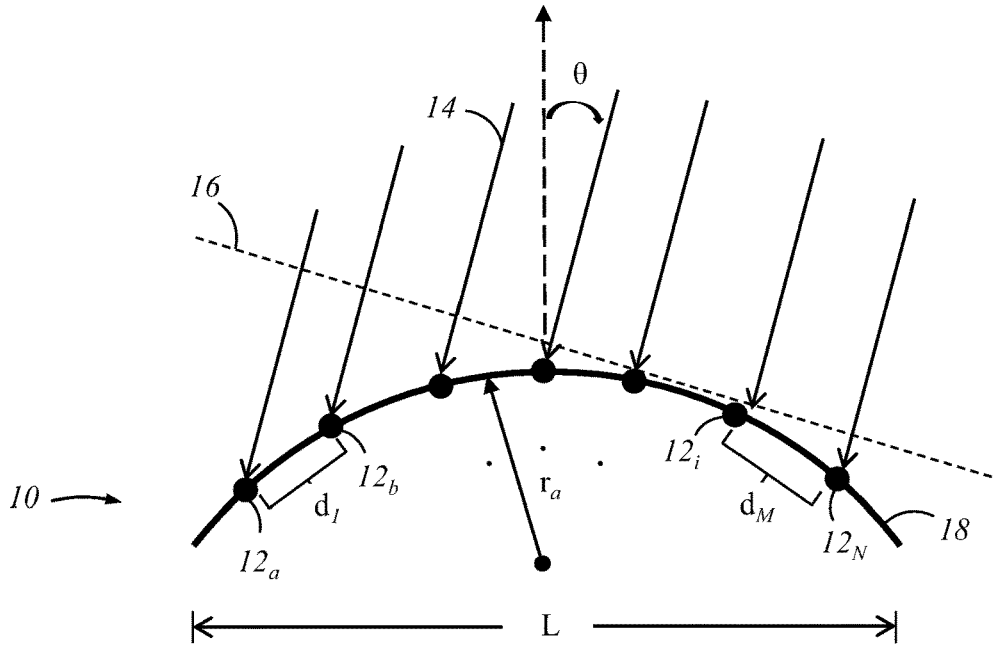
FIG. 1 illustrates an exemplary antenna array according to an embodiment of the present invention.

FIG. 1 illustrates an exemplary antenna array 10 according to at least one embodiment of the present invention. Antenna array 10 includes a plurality of antenna elements $12_{a\text{-}N}$ arranged along a convex curved surface 18 of the antenna array 10. The location of each antenna element $12_{a\text{-}N}$ on the array 10 is given by position $P_{1\text{-}N}$, wherein $P_i$ ($x_i$, $y_i$, $z_i$) represents the location of the $i^{th}$ antenna element on the array 10. The position P of each antenna element $12_{a\text{-}N}$ on the array is determined by the disclosed method in a manner that exploits the curvature of the array surface 18 and maximizes the angular resolution across the entire field-of-view (FOV). As understood by one of ordinary skill the art, the FOV varies depending on the geometric configuration of the antenna array 10. For the convex curved array 10 shown in FIG. 1, the FOV varies in response to the radius $r_a$ of the array curvature and overall length L of the array 10. The angle of arrival θ of the incoming incident signals 14 is referenced from an axis perpendicular to the plane of the array elements (i.e., broadside to the array) and ranges in angle from π/2 to −π/2 (90° to −90°). The wave front 16 formed by the incoming signals 14 is perpendicular to the direction of the plane wave as indicated by the incoming signals 14. It is assumed that all points on the wave front 16 have equal amplitude and phase values. The antenna elements $12_{a\text{-}N}$ are spatially separated by distances $d_{1\text{-}M}$, which vary depending on the placement of each antenna element $12_{a\text{-}N}$ on the convex curved surface 18. The distances may be measured directly between the elements along the surface of the array, or may be measured based on the distance between the antenna elements as their positions are projected onto an axis perpendicular to the array broadside.

Figure 2:
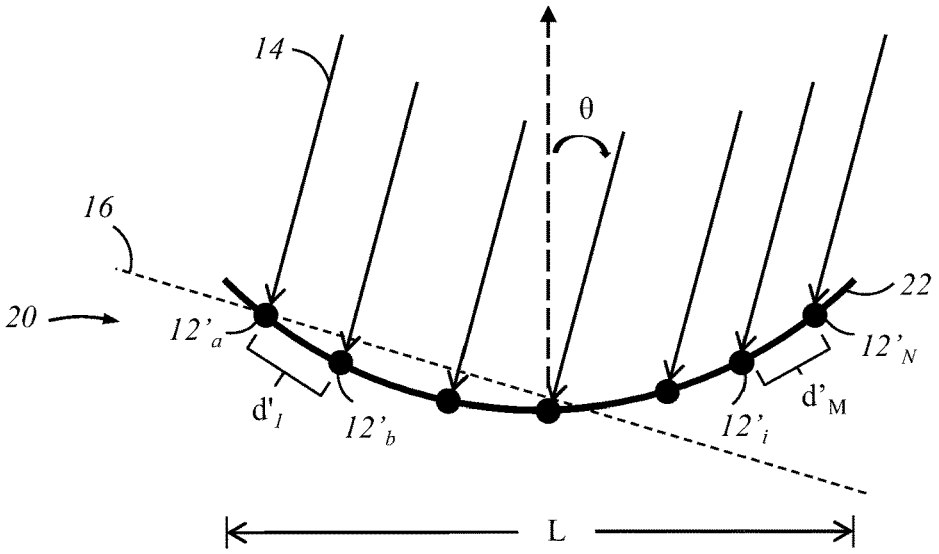
FIG. 2 illustrates another exemplary antenna array according to an embodiment of the present invention.

FIG. 2 illustrates another exemplary antenna array 20 according to another embodiment of the present invention. Antenna array 20 includes a plurality of antenna elements $12'_{a\text{-}N}$ spatially separated by distances $d'_{1\text{-}M}$. The antenna elements $12'_{a\text{-}N}$ are arranged along a concave curved surface 22 at positions $P'_{1\text{-}N}$, wherein $P'_i$ ($x_i$, $y_i$, $z_i$) represents the location of the $i^{th}$ antenna element on the array 20. The distances $d'_{1\text{-}M}$ between the antenna elements $12'_{a\text{-}N}$ vary depending on the placement of each antenna element $12_{a\text{-}N}$ on the curved surface 22, which is determined in a manner set forth by the disclosed method that exploits the curvature of the array surface 22 and maximizes the angular resolution across the entire field-of-view (FOV). As with the convex antenna array 10 shown in FIG. 1, the FOV for the concave antenna array 20 depends on the radius $r_a$ of the concave surface 22. However, due to the concave geometry, antenna array 20 has a narrower FOV and generally has a thicker antenna depth than an antenna array having a convex surface.

The approach and methodology described below relate to the antenna array configurations shown in FIGS. 1 and 2, however, one of ordinary skill in the art appreciates that the specific arrangements shown are merely exemplary, and in many ways, have been simplified for ease of explanation. For example, while FIGS. 1 and 2 illustrate exemplary one-dimensional linear arrays, one of ordinary skill in the art appreciates that the concepts and method disclosed herein may be applied to any suitable curved antenna array with any geometric configuration including, but not limited to, other linear arrays configurations, two-dimensional planar arrays, and/or conformal arrays.

Figure 3:
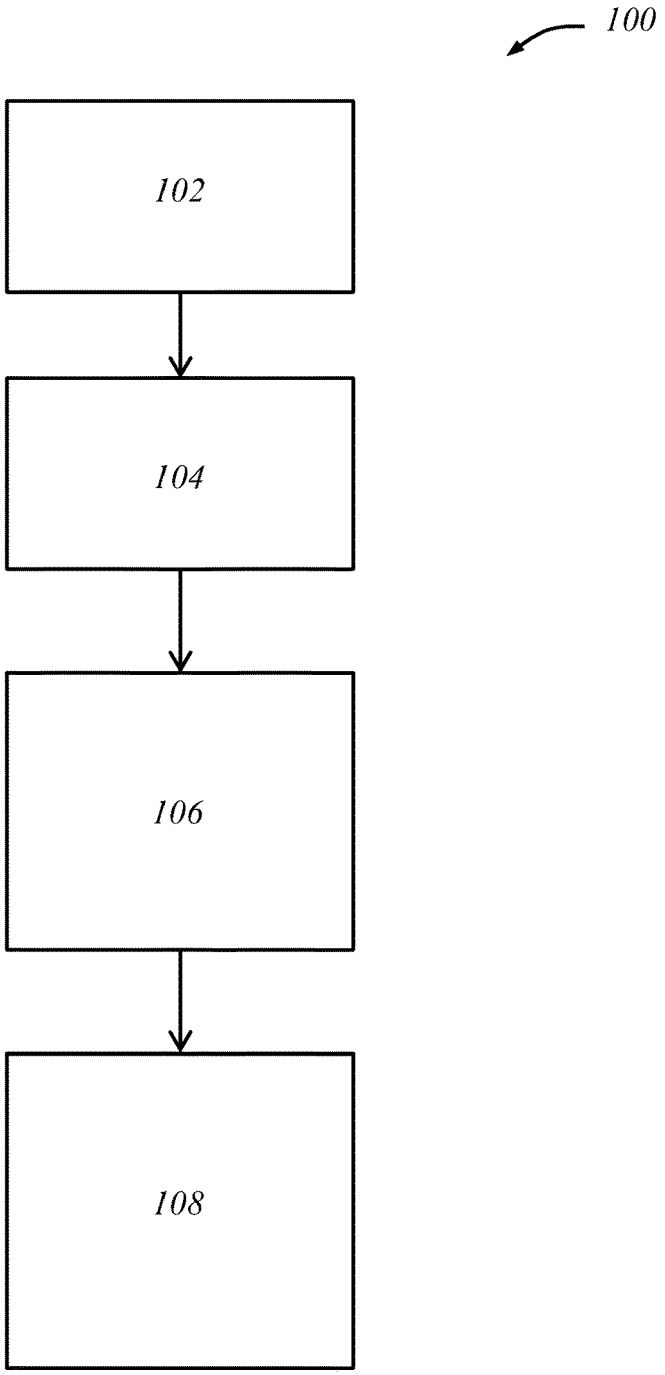
FIG. 3 illustrates a flow chart depicting a method according to an embodiment of the invention for optimizing the angular resolution of an antenna array across the entire field-of view.

FIG. 3 illustrates an exemplary method 100 for optimizing the angular resolution across an entire field-of view (FOV) for an antenna array having a curved surface. The surface of the array may be convex or concave as illustrated above in FIGS. 1 and 2. The disclosed method 100 determines optimized positions for each antenna element on the curved surface of the array such that the angular resolution is constant and maximized across the entire FOV for that given array geometry. For ease of explanation, the method 100 described below is with reference to the convex curved surface array 10 shown in FIG. 1, but is equally applicable to concave surface array 20 shown in FIG. 2.

As understood by those skilled in the art, angular resolution refers to the minimum angular separation at which two equal targets at the same range can be separated. The angular resolution characteristics of a radar are generally determined by the antenna beam width represented by the −3 dB angle $\theta_{3\ db}$, which is defined by the half-power (−3 dB) points on the main beam of the antenna's radiation pattern. The half-power points of the antenna radiation pattern (i.e. the −3 dB beam width) are normally specified as the limits of the antenna beam width for the purpose of defining angular resolution. Two identical targets at the same distance are, therefore, resolved in angle if they are separated by more than the antenna beam width. The smaller the beam width $\theta_{3\ db}$, the higher the directivity of the antenna and the better the angular resolution. As understood by one of ordinary skill in the art, there are many different ways to express angular resolution in terms of the beam width of antenna array. In general, the beam width $\theta_{3\ db}$ is based on one or more of: the wavelength λ of the incoming signals 14, the overall length L of the antenna aperture, the number of antenna elements N, the distance d between the antenna elements, a slant range aim measured between the antenna and the target, the radius of the curvature of the antenna array, and the angle of arrival θ of the incoming signals 14.

The method 100 begins at step 102 by defining select design parameters, which may include without limitation or constraint, a number of antenna elements N, a geometry for a given array surface, and a metric for array resolution. At step 104, a grid is defined on the given array surface for all possible array configurations (i.e., all possible antenna element locations on the array surface for a given number N of antenna elements). As appreciated by those skilled in the art, a grid may represent a two-dimensional surface in space or a three-dimensional volume in space. Moreover, one of ordinary skill in the art further appreciates that the number and arrangement of possible array configurations may be derived empirically according to known methods.

At step 106, an angular resolution metric is calculated for each possible array configuration on the defined grid. The array configuration having the optimal angular resolution over the entire FOV, based on the design parameters defined in step 102, is determined at step 108 by minimizing the angular resolution metric. In other words, the optimal antenna element positions for a given array curvature is determined by selecting the array configuration that attained the minimal resolution metric.

Referring to the angular resolution metric defined in step 102 and calculated in step 104, one of ordinary skill in the art appreciates that any metric relating to angular resolution may be implemented to determine the optimal antenna element locations for a given surface geometry. In one embodiment, the angular resolution metric may relate to known beamforming techniques, such as the Bartlett beamformer, as described in detail below.

In one example of step 104, let $P(\theta, \theta_0)$ be a beamforming spectrum at angle θ for each of the possible array antenna configurations at a target arriving at angle $\theta_0$, wherein the beamforming spectrum is given by:

$$P(\theta, \theta_0) = \left[1 e^{-\frac{j2\pi d\sin(\theta)}{\lambda}} e^{-\frac{j2\pi 2d\sin(\theta)}{\lambda}} \ldots e^{-\frac{j2\pi(N-1)d\sin(\theta)}{\lambda}}\right] \times (\theta_0)$$

where d is the spacing between antenna elements in a given array configuration, $\lambda$ is the wavelength of the transmitted signal, N is the number of antenna elements, and x is the incoming signal vector. Let $B(\theta_0)$ be the 3 dB width of the main-lobe (width in angle units) in the beamforming spectrum centered around the target arrival angle $\theta_0$ (i. e., $P(\theta_0+\Delta, \theta_0) \geq 0.5\ P(\theta_0, \theta_0)$). Therefore, the resolution metric for a given antennas configuration, $\Lambda$, is given by $$\mu_\Lambda = \max_{\theta \in \Omega} B(\theta) \text{subjected to } S < A$$

where $\Omega$ is the desired field of view, A is preconfigured, S is the ration between the main peak lobe $P(\theta_0, \theta_0)$ and the maximum secondary peak in the beamforming spectrum $P(\theta, \theta_0)$ for any $\theta$ in the FOV, which is often referred to as the maximal side lobe level. Minimizing $\mu_\Lambda$ over a set of possible array configurations results in an array that has a good resolution quality over the entire FOV.

Figure 4:
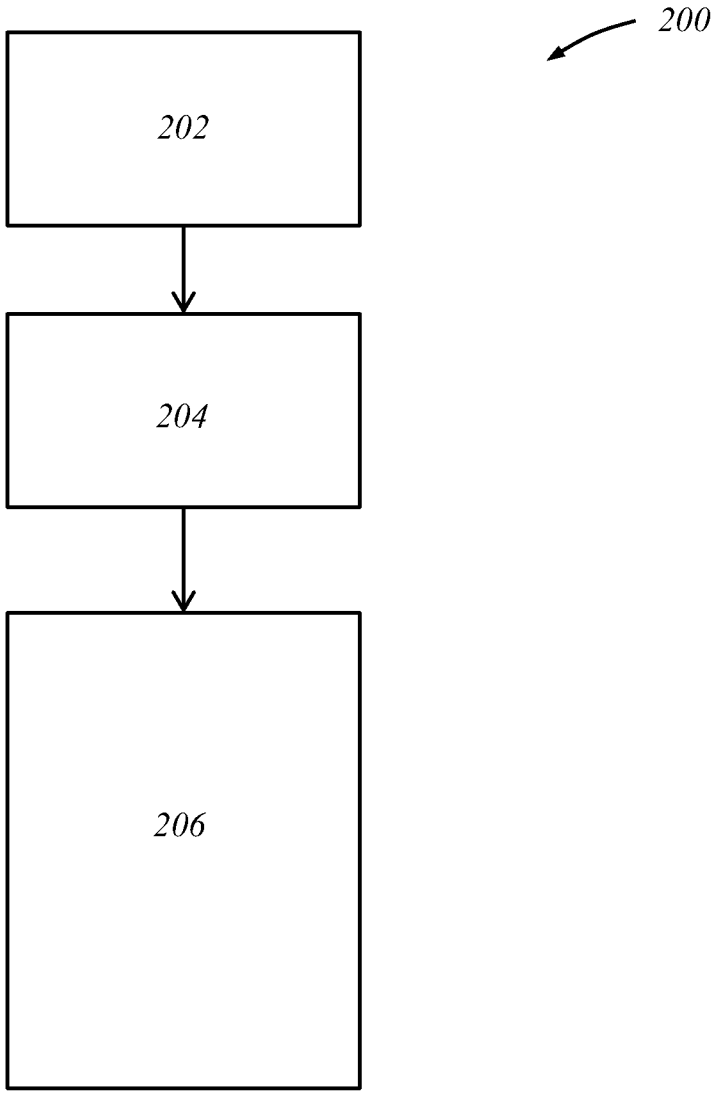
FIG. 4 illustrates a flow chart depicting another method according to an embodiment of the invention for optimizing the angular resolution of an antenna array across the entire field-of view.

An alternative method 200 for optimizing the angular resolution across an entire field-of view (FOV) for an antenna array having a curved surface is shown in FIG. 4. The method 200 begins at step 202 by selecting a position $P_1$ for the first antenna element $\mathbf{12}_a$ on the convex curved surface 18 of the array 10. In one embodiment, the position $P_1$ of the first antenna element $\mathbf{12}_a$ serves as a reference position and is selected arbitrarily, but may be selected based on the geometry of a particular array and/or the number of antenna elements N being used for the array 10. At step 204, an angle $\theta$ representing the angle of arrival of incident signals 14 is defined for all angles in the desired FOV, which in one embodiment is 180° and is referenced from an axis perpendicular to the plane of the array elements and therefore ranges from −90° to 90°.

The position $P_i$ for each antenna element $\mathbf{12}_i$ on the curved surface 18 of the array 10 is determined at step 106 based on an argument of the maximum of an angular resolution function. Often denoted by the abbreviation $\arg_x \max f(x)$, the argument of the maximum is a known mathematical operation that generates a point, or set of points, of a given argument for which the function attains its maximum value. In this case, the function is an angular resolution function and the argument of the maximum is used to calculate a position $P_i$ for each antenna element $\mathbf{12}_i$ that creates a maximum angular resolution for the given array 10 over all of the angles $\theta$ in the FOV. Stated in simplistic form, the method 100 utilizes the argument of the maximum operation to "search" for antenna element positions for which maximum resolution is achieved over the desired FOV.

In one embodiment, the angular resolution function used to calculate the position of the antenna elements $\mathbf{12}_i$ on the curved surface 18 of the array 10 is given by the following: the beam width $\theta_{3\ db} = 0.866\lambda/(Nd)$, wherein $\lambda$ is the wavelength of the incident signals 14, N is the number of antenna elements, and d is the distance between the antenna elements. One of ordinary skill in the art appreciates that the angular resolution function recited above is merely exemplary and that the angular resolution equation, the variables of the equation, and relationship between those variables may vary depending on the geometry of the antenna array and other application specific criteria.

In one non-limiting example, a simplified algorithm for optimizing the position of antenna elements for a given antenna curvature according to the disclosed method 200 is given by:

```
P_1 = the position of the first antenna element;
  For Theta = -90 : 90; // Angles in the desired FOV;
    For i = 2 : N; // N is the number of antenna elements in the array;
     P_i = arg{max{Angular_Resolution}}; // Calculates antenna
element position(s) at which maximum resolution is achieved;
End
  End
```

The exemplary algorithm set forth above iterates the "For" loop until the angular resolution function converges to a maximum for all N antenna elements in the array for the designated FOV. As may be appreciated by one skilled in the art, the above-algorithm may be implemented in a number of different ways. For example, in one embodiment, the position $P_i$ for each antenna element $\mathbf{12}_i$ in the array 10 is determined individually based on the position of the first element and any other previously calculated antenna elements. In other words, the argument of the maximum function is implemented as an iterative loop and generates a location for one antenna element at a time, individually and sequentially, taking into consideration the position of previously located elements, until a location for each of the antenna elements in the array has been identified. In another embodiment, the position of the antenna elements is calculated as a set of solutions such that the position $P_i$ is a set of antenna element positions for which maximum angular resolution is attained for all angles $\theta$ in the FOV.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A method for optimizing an angular resolution across a field-of view for an antenna array having a plurality of antenna elements positioned along a curved surface, the method comprising the steps of:

selecting a position along the curved surface for a first antenna element in the plurality of antenna elements; and calculating subsequent positions for each of the remaining plurality of antenna elements on the antenna array, wherein the subsequent positions are determined relative to the position of the first antenna element and wherein the subsequent positions represent positions at which a maximum angular resolution is achieved for all angles in the field-of-view;

wherein calculating the subsequent positions includes applying an argument of the maximum operation to an angular resolution function.

2. The method of claim 1, wherein the position of the first antenna element along the curved surface is selected arbitrarily.

3. The method of claim 1, wherein the position of the first antenna element along the curved surface is selected based on a number of antenna elements in the antenna array and a geometry of the curved surface.

4. The method of claim 1, wherein the angular resolution function is based on one or more of: a wavelength of the incoming signals, a length of the antenna array, a number of antenna elements, a distance between the antenna elements, a slant range aim measured between the antenna array and a target, a radius of the curvature of the antenna array, and/or an angle of arrival of the incoming signals.

5. The method of claim 1, wherein the angular resolution function is based on a −3 dB beamwidth, a length of the antenna array, and a wavelength of the incoming signals.

6. The method of claim 1, wherein calculating the subsequent positions for each of the remaining plurality of antenna elements includes evaluating a maximum angular resolution function for each angle in the field-of-view.

7. The method of claim 1, wherein the plurality of antenna elements are separated by a non-uniform distance.

8. The method of claim 1, wherein the curved surface of the antenna array is concave.

9. The method of claim 1, wherein the curved surface of the antenna array is convex.

10. The method of claim 1, wherein the antenna array is a one dimensional linear array.

11. The method of claim 1, wherein the antenna array is a two dimensional planar array.

12. The method of claim 1, wherein the antenna array is a one dimensional linear array.

13. The method of claim 1, wherein the antenna array is a two dimensional planar array.

14. A method for optimizing an angular resolution across a field-of view for an antenna array having a plurality of antenna elements positioned along a curved surface, the method comprising the steps of:

determining a range of angles in the field-of-view;

determining a position on the curved surface for each of the plurality of antenna elements by;

defining an angular resolution metric based on the field of view and a maximum side lobe level; and minimizing the angular resolution metric over a set of possible array configurations to obtain the position on the curved surface for each of the plurality of antenna elements, wherein the positions of the plurality of antenna elements represent an array configuration for which a maximum angular resolution is achieved for the range of angles in the field-of-view with respect to angular resolutions that would be achieved for the range of angles in the field of view according to the set of possible array configurations.

15. An antenna array, comprising:

a curved surface having a given curvature; and a plurality of antenna elements disposed along the curved surface having non-uniform spacing, the position of each of the plurality of antenna elements is determined by maximizing an angular resolution function for all angles in a given field-of-view, wherein:

a first antenna element in the plurality of antenna elements has a position along the curved surface; and each of the remaining plurality of antenna elements has a subsequent position along the curved surface, the subsequent positions of the remaining antenna elements are determined relative to the position of the first antenna element, wherein the subsequent positions are calculated by applying an argument of the maximum operation to the angular resolution function.

16. The antenna array of clam 15, wherein the curvature of the curved surface is concave.

17. The antenna array of clam 15, wherein the curvature of the curved surface is convex.

* * * * *